US005223665A

United States Patent [19]

Burleson et al.

[11] Patent Number: 5,223,665

[45] Date of Patent: Jun. 29, 1993

[54] METHOD AND APPARATUS FOR DISABLING DETONATION SYSTEM FOR A DOWNHOLE EXPLOSIVE ASSEMBLY

[75] Inventors: John D. Burleson, Katy; Dieter Klein, Houston, both of Tex.

[73] Assignee: Halliburton Company, Duncan, Okla.

[21] Appl. No.: 823,370

[22] Filed: Jan. 21, 1992

[51] Int. Cl.[5] ..... F42B 3/00

[52] U.S. Cl. ..... 102/312; 102/313; 175/4.56; 166/63

[58] Field of Search ..... 102/312, 313; 175/4.56; 166/63

[56] References Cited

U.S. PATENT DOCUMENTS

| | | | |
|---|---|---|---|
| 3,313,234 | 4/1967 | Mohaupt | 102/313 |
| 4,614,156 | 9/1986 | Colle, Jr. et al. | 166/63 X |
| 4,616,718 | 10/1986 | Gambertoglio | 175/4.56 X |
| 4,836,109 | 6/1989 | Wesson et al. | 102/312 |
| 4,862,964 | 9/1989 | George et al. | 166/297 |
| 4,901,802 | 2/1990 | George et al. | 175/4.52 |
| 4,917,189 | 4/1990 | George et al. | 166/297 |
| 4,945,984 | 8/1990 | Price | 166/63 |
| 5,062,485 | 11/1991 | Wesson et al. | 166/297 |

OTHER PUBLICATIONS

"Hammer Stop and Shock Block for Tubing Conveyed Perforating," High Pressure Integrity, Inc., New Orleans, La. (dated at last as early as Jul. 23, 1992) pp. 1-8.

J. V. Carisella, Sc.D. et al., "SPE #22556 Three New Systems Which Prevent Firing of Perforating Guns and String Shots on or Near the Surface," High Pressure Integrity, Inc., New Orleans, La. (presented for SPE publication Jul. 1991), pp. 1-24.

*Primary Examiner*—Peter A. Nelson

*Attorney, Agent, or Firm*—Arnold, White & Durkee

[57] ABSTRACT

A method and apparatus adapted to disable the actuation assembly for a perforating gun or any other detonation device used in subterranean wells to prevent premature surface detonation of the device. An apparatus is provided which can be quickly and easily connected in a tubing string intermediate the firing head and the perforating gun or other detonation device. In a preferred embodiment, the invention comprises a cylinder and firing piston combination wherein a chamber is provided between the cylinder wall and the firing piston. The chamber contains a transition material, such as an eutectic alloy. The transition material changes state from a solid to a fluid when the temperature of the material is increased above the material's "melting temperature." The transition material changes back from a fluid to a solid when the temperature of the material is decreased below the material's "melting temperature." When the transition material is in a solid state, as it is at the surface, movement of the firing piston is prevented by the shear strength of the solid transition material. When the transition material is in a fluid state, as it is at the requisite depth downhole, movement of the firing piston is not significantly inhibited due to the decreased shear strength of the fluid transition material. When the firing head is detonated at the requisite depth downhole, the pressure from the firing head detonation is sufficient to urge the firing piston forward, detonating the perforating gun or other detonation device.

37 Claims, 4 Drawing Sheets

METHOD AND APPARATUS FOR DISABLING DETONATION SYSTEM FOR A DOWNHOLE EXPLOSIVE ASSEMBLY

BACKGROUND OF THE INVENTION

The present invention relates generally to methods and apparatus adapted to disable the actuation assembly for a perforating gun or another detonation device used in subterranean wells; and, more specifically, relates to methods and apparatus for performing such disabling through use of a material which changes state under generally predetermined or known conditions.

As is well known in the art, a perforating gun is utilized to perforate well casing, or other oil field tubular members, and the surrounding environment, to facilitate the flow of fluids from external to the casing to the interior of the casing. The environment surrounding the casing will typically include concrete sheeting as well as the earth formation itself. In present times, the perforating is typically performed through detonation of explosive shaped charges.

Because of the forces generated during detonation of a perforating gun, a major concern in the industry has always been the avoidance of any accidental or untimely detonation of the perforating gun. For example, a detonation of a perforating gun at the surface of the earth is likely to cause significant damage to property in the vicinity of the perforating gun, and serious injury, if not death, to persons in the vicinity.

Downhole explosive devices, such as a perforating gun, are typically actuated through firing heads which are responsive to either mechanical forces or fluid pressure. So-called mechanically actuated firing heads are typically responsive to an impact such as may be provided by the dropping of a detonating bar through the tubing to impact an actuation piston in the firing head. So-called "hydraulically-actuated" firing heads are responsive to a source of fluid pressure, such as in either the well tubing or the well annulus, which will move an actuation piston in the firing head to initiate detonation of the perforating gun. Additionally, some hybrid systems exist, wherein a mechanical impact will be used to release the firing head, while an actuation piston will actually be moved by fluid pressure. An example of this type system is disclosed in U.S. Pat. No. 4,911,251, issued Mar. 27, 1990, to Flint George et al., and assigned to the assignee of the present invention. Such firing heads, where the piston is moved in response to hydraulic pressure, are believed to enhance the safety of the detonating system in that they are unlikely to detonate without a specific source of substantial fluid pressure. Such a source of fluid pressure would be expected to be found only within the wellbore.

In one attempt to provide a safety mechanism for a mechanically-actuated firing head, one company has proposed the use of an eutectic alloy placed beneath the head of the impact piston and the body of the firing head. Upon melting, the alloy will flow from beneath the piston in the firing head. The expectation is that the alloy, which forms a restraining block, will prevent substantial movement of the impact piston when the alloy is in a solid state, but will allow movement of the firing pin when the alloy is in a liquid state. The alloy is selected to change state from solid to liquid at a temperature which is less than the temperatures to which the perforating assembly will be exposed within the wellbore. Accordingly, upon temperatures exceeding the threshold temperature, or "melting temperature," at which the change of state occurs, the firing pin would be moveable in response to a mechanical impact. A paper describing the system is that identified as "SPE #22556 Three New Systems which Prevent Firing of Perforating Guns and String Shots On or Near the Surface", presented for SPE publication July 1991, by J. V. Carisella, Sc.D. and R. B. Cook, High Pressure Integrity, Inc., and J. E. Beardmore, Jr., Marathon Oil Company.

A problem with such system, however, is that design compromises must be evaluated relative to providing a large enough block to prevent a movement of the impact piston which would be sufficient to detonate the ignition charge, but which is not so large as to provide either an unrealistic barrier to movement of the firing pin even when in the liquid state or which would take an unreasonably large amount of time to change state to a degree sufficient to allow movement of the firing pin.

In addition, when the conventional system is inserted in the wellbore and is later withdrawn before the ignition charge has been detonated, as is not uncommon, the effectiveness of the conventional safety mechanism is greatly diminished. This is particularly true when the conventional system is not substantially vertically oriented when it is down the wellbore: i.e., when the conventional system is inserted into the string of tools in an upside down configuration (as is often done to provide a secondary means of detonating the perforating gun should the primary means fail) or when the conventional system is inserted in a deviated wellbore.

Accordingly, the present invention provides new methods and apparatus whereby detonation is interrupted whenever the firing head assembly or other detonating assembly is not in the wellbore. However, detonation is uninterrupted whenever the assembly is in the wellbore at a sufficient depth. Thus, the problems associated with the conventional safety mechanism are avoided.

SUMMARY OF THE INVENTION

The present invention provides an apparatus and method for disabling a firing head assembly in oil field equipment, thus preventing detonation whenever the equipment is not in the wellbore or "downhole". In one preferred embodiment, the present invention may be used in conjunction with an apparatus for completing a well by perforating and producing fluid from the well: i.e., a perforating gun. When the perforating gun is not downhole, the apparatus of the present invention will not generate a detonation signal to the perforating gun (such as the igniting of an ignition charge), regardless of whether an actuation signal is received by the apparatus (such as by mechanical impact upon a firing head). Thus, the detonation interruption apparatus interrupts detonation between the firing head assembly and the perforating gun when the perforating apparatus is not downhole, thereby preventing premature detonation of the perforating gun.

One preferred embodiment of the present invention comprises a distinct unit which may be quickly and easily screwed into a tool string between the firing head and the perforating gun. The unit is therefore adaptable to any firing head, regardless of the type of actuation signal to which the firing head is responsive. The embodiment is equally effective with a mechanically-actuated firing head, a hydraulically-actuated firing head or a hybrid mechanically/hydraulically-actuated firing head.

Another preferred embodiment herein illustrates the present invention incorporated into a firing head which is responsive to a combination mechanical and hydraulic actuation signal. This embodiment may likewise be adapted for use with any firing head, regardless of the type of actuation signal to which the firing head is responsive.

In one preferred embodiment, the detonation interruption apparatus comprises an extended annular ring formed around a firing pin. The annular ring is filled with a transition material. A transition material is one which has a high shear strength when the material is in a solid state. However, when the transition material is in a fluid state, it has a relatively low shear strength.

In one preferred embodiment, the transition material is an eutectic alloy. The eutectic alloy remains in a solid state at ambient surface temperatures. Thus, at the surface, movement of the firing pin is virtually prevented by the solidified eutectic alloy. As the perforating assembly is lowered downhole, the temperature of the eutectic alloy rises above the surface temperature. At a certain depth, the temperature rises above the "melting temperature." The "melting temperature" is the temperature at which the eutectic alloy changes state from solid to liquid. Since the eutectic alloy has a low shear strength when it is in a liquid state, movement of the firing pin is substantially inhibited only by shear pins, which will shear when a predetermined detonation force is applied to the firing pin which exceeds the design limits of the shear pins.

For various reasons, it is sometimes desirable to retrieve the equipment from downhole even through the equipment has not yet been detonated. As the equipment is raised, the temperature of the eutectic alloy drops. At a certain depth, the temperature drops below the "melting temperature." The eutectic alloy in the annular ring resolidifies and again movement of the firing pin is virtually prevented by the solidified eutectic alloy. Thus, the safety mechanism renders the apparatus virtually inoperative whenever the equipment is exposed to ambient surface temperatures.

DETAILED DESCRIPTION OF A PREFERRED EMBODIMENT

Figure 1:
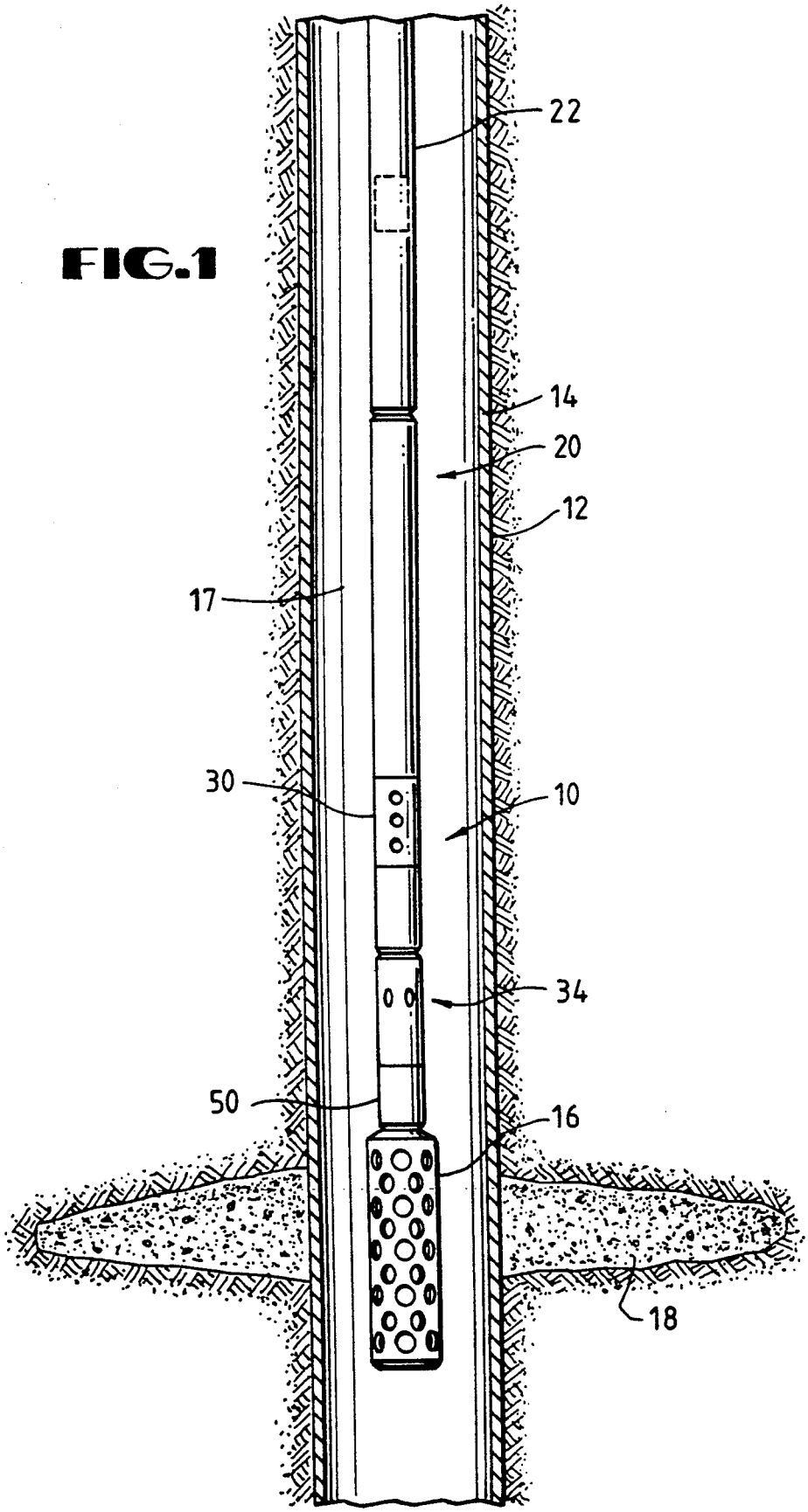
FIG. 1 schematically depicts a perforating apparatus disposed within a well, illustrated partially in vertical section. The assembly incorporates a detonation interruption apparatus in accordance with the present invention.

Referring now to FIG. 1, therein is schematically depicted one example of a perforating apparatus, shown generally at 10, disposed within a well 12. Perforating apparatus 10 incorporates a detonation interruption apparatus 50 in accordance with the present invention. Well casing 14 lines the bore of well 12 in a manner well known to those skilled in the art. Perforating apparatus 10 is inserted into the bore of well 12 until perforating gun 16 is proximate the oil or gas formation 18 which is to be perforated. Perforating apparatus 10 is said to be "downhole" when it is inserted into the bore of well casing 14.

Perforating apparatus 10 comprises a tool string, shown generally at 20. Well annulus 17 is formed between tool string 20 and well casing 14. Tool string 20 is coupled to tubing string 22. Tool string 20 includes a ported sub 30 providing fluid communication between annulus 17 and the interior of tubing string 22. Coupled in tool string 20 beneath ported sub 30 is a hydraulically-actuated firing head assembly, shown generally at 34. Hydraulically-actuated firing head assembly 34 includes firing head 36 which is threadedly coupled at its lower end to the upper end of detonation interruption apparatus 50. Detonation interruption apparatus 50 is, in turn, threadedly coupled at its lower end to perforating gun 16.

Figure 2:
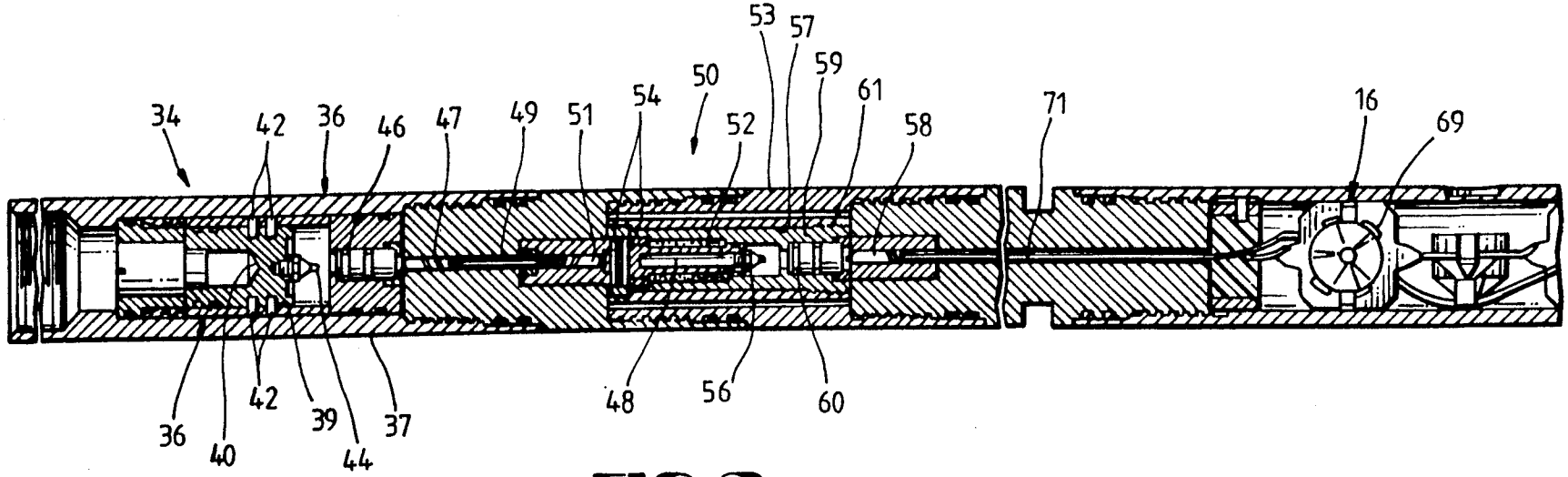
FIG. 2 depicts a cross-sectional side view of the perforating assembly of FIG. 1, including the firing head assembly, the detonation interruption apparatus and a perforating gun.

Referring now to FIG. 2, therein is shown a more detailed schematic showing firing head assembly 34, including firing head 36 and detonation interruption apparatus 50. In one preferred embodiment, one end of detonation interruption apparatus 50 is provided with a threaded male extension and the other end of detonation interruption apparatus 50 is provided with a female cavity similarly threaded, so that detonation interruption apparatus 50 can be quickly and easily screwed into tool string 20 between firing head 36 and perforating gun 16.

Firing head 36 includes a housing 37, which includes a central bore 39. Contained within central bore 39 is a piston 40 which includes a firing pin 44. Hydraulically-responsive piston 40 is held in a first position relative to housing 37 by a plurality of shear pins 42. In one preferred embodiment, piston 40 is retained in place by four shear pins 42. In a manner known to the art, when the fluid pressure in tubing string 22 reaches a predetermined level, established by the yield strength of shear pins 42, shear pins 42 are sheared and piston 40 is urged downward under hydraulic pressure to a second position. Firing pin 44 is designed to strike first initiator 46 as piston 40 moves to this second position. When firing pin 44 strikes first initiator 46, it ignites and detonates first booster 47. First booster 47, in turn, detonates first detonating cord 49. When the detonation reaches the lower end of first detonating cord 49, a second booster 51 is detonated. The detonation of second booster 51, along with the detonation of first detonating cord 49, generates a pressure which under generally predetermined conditions will cooperate with detonation interruption apparatus 50 to cause detonation of perforating gun 16, in a manner to be described herein following a description of the structure of detonation interruption apparatus 50.

Figure 3:
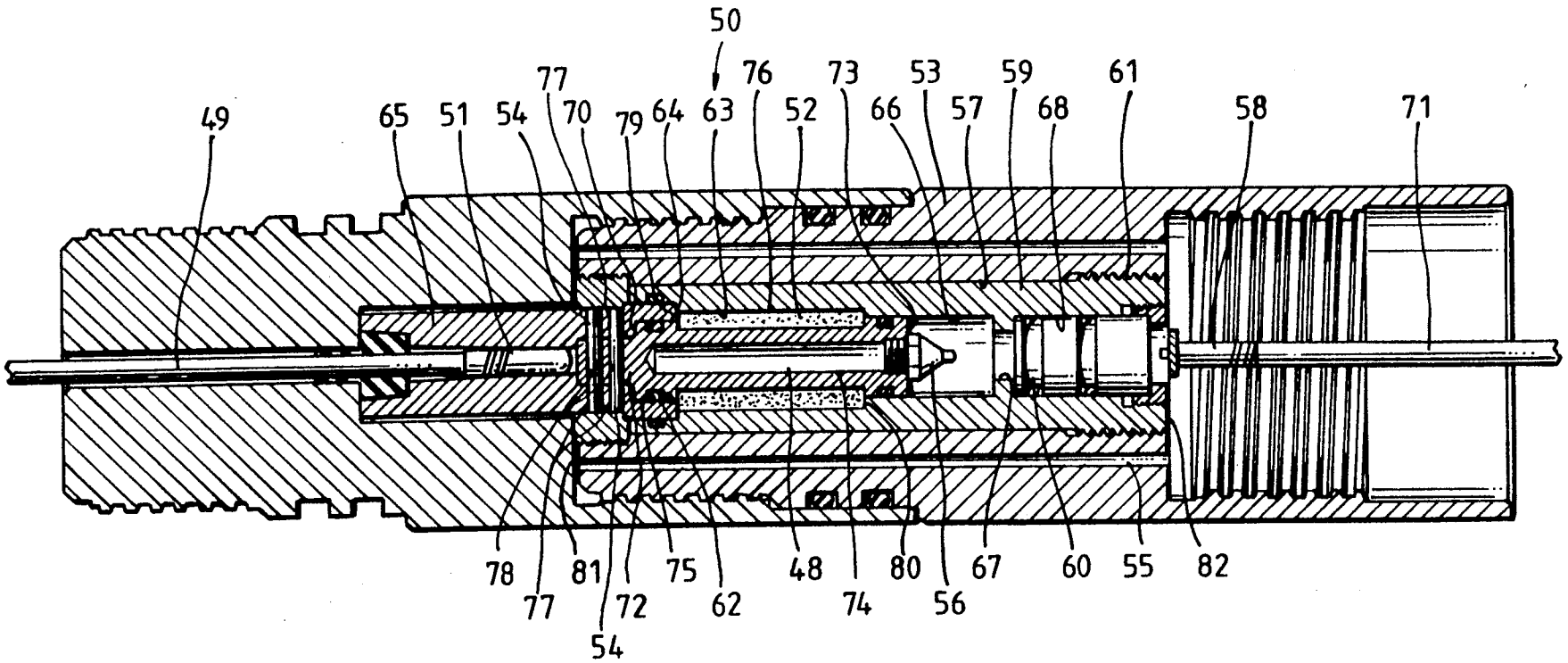
FIG. 3 depicts an enlarged cross-sectional side view of the detonation interruption apparatus of FIG. 2.

Referring now also to FIG. 3, therein is depicted detonation interruption apparatus 50, in greater detail. Detonation interruption apparatus 50 includes a housing 53 defining a central bore 57. Housing 53 preferably also defines one or more passageways 55, which provide for fluid communication between mating surface 81 and mating surface 82. Threadably retained within central bore 57 is a firing pin sleeve 59. Firing pin sleeve 59 will preferably be retained within central bore 57 by a threaded coupling, such as at 61. Firing pin sleeve 59 includes a central bore therethrough having sections of varying diameters. Firing pin sleeve 59 includes a first bore section 62 of a first, relatively large, diameter. Longitudinally adjacent bore section 62 is a second bore section 63, of relatively reduced diameter. The transition between bore sections 62 and 63 is abrupt, forming a shoulder 64 adapted to engage an adjacent end of a retention block 65. A third bore section 66 includes a further relatively reduced diameter portion adapted to sealingly engage the surface of a lower piston section 73 of firing pin piston assembly 48. Firing pin sleeve 59 includes an apertured section 67 sized to allow passage of firing pin 56 of firing pin piston assembly 48 therethrough. Finally, a relatively enlarged section 68 of firing pin sleeve 59 houses a second initiator 60.

Firing pin piston assembly 48 includes, as previously discussed, lower piston section 73. Additionally, firing pin piston assembly 48 includes an upper piston section 75 adapted to sealingly engage a recess 70 in retention block 65. Firing pin piston assembly 48 includes a piston shaft 74 intermediate lower piston section 73 and upper piston section 75. Piston shaft 74 will preferably be hollow to reduce the mass of firing pin piston assembly 48. Piston shaft 74 will preferably be of a relatively reduced diameter relative to lower piston section 73 and upper piston section 75. Upper piston section 75 and lower piston section 73 are preferably of equal diameters. Passageways 55 provide fluid communication between mating surface 81 and mating surface 82, as has already been described. Accordingly, even if fluid were to leak into a section of detonation interruption apparatus 50, firing pin piston assembly 48 will remain pressure balanced to any fluid pressure applied between upper piston section 75 and lower piston section 73. Thus, pressure above firing pin piston assembly 48 resulting from fluid leakage is prevented from urging the assembly 48 downward toward second initiator 60. Firing pin piston assembly 48 further includes an extension portion 72 having one or more apertures 78 therein. Apertures 78 are oriented to align with complimentary apertures 77 in retention block 65 such that shear pins 54 may be inserted therethrough to retain firing pin piston assembly 48 in a first, unactuated, position relative to retention block 65.

Piston shaft 74 and bore section 63 cooperatively define an annular chamber 76. This annular chamber 76 is filled with a transition material to form a solid annular ring 52. The transition material has an increased shear strength when it is in a solid state. Thus, when the transition material is in a solid state, it bears on its upper surface against shoulder 79 of retention block 65, and against upper piston section 75 of firing pin assembly 48, and it bears on its lower surface against shoulder 80 between bore sections 63 and 66, and against lower piston section 73 of firing pin assembly 48, to thereby prevent movement of firing pin piston assembly 48. However, the transition material has a substantially decreased shear strength when it is in a fluid state. Thus, when the transition material is in a fluid state, it will not significantly inhibit the movement of firing pin piston assembly 48.

The transition material is selected to be in a solid state when the material is at ambient surface temperatures. That is, when the transition material is at a temperature below the "melting temperature" (i.e., when the perforating apparatus is not downhole), the transition material will be in a solid state. However, when the transition material is at a temperature above the "melting temperature" (i.e., when the perforating apparatus is downhole), the transition material will be in a fluid (typically liquid) state.

One transition material which has been found to display the requisite characteristics is an eutectic alloy. An eutectic alloy is a composition which changes state from solid to liquid when the temperature of the material is increased above a predetermined temperature and which changes state from liquid to solid when the temperature of the material is decreased below the same predetermined temperature. This predetermined temperature is referred to herein as the "melting temperature" of the eutectic alloy. Eutectic alloys characteristically have increased shear strength when the alloy is in a solid state and have decreased shear strength when the alloy is in a liquid state.

Various eutectic alloys suitable for use with the present invention are available through Belmont Metals Inc., and are sold under the designations "Belmont Alloy 2451" and "Belmont Alloy 2581." Eutectic alloys available consist of compositions of varying percentages of bismuth, lead, tin and cadmium, as well as other elements. Eutectic alloys are available which have "melting temperatures" ranging anywhere from about 117 degrees Fahrenheit to about 281 degrees Fahrenheit. The eutectic alloy selected for a given application will depend on a variety of factors, including the highest potential ambient surface temperature (i.e., an alloy having a lower "melting temperature" may be used in Alaska in winter whereas an alloy having a higher "melting temperature" is preferable in Saudi Arabia in summer) and the depth downhole at which perforating apparatus 10 is to be operated (generally, the greater the depth downhole, the higher the temperature to which the apparatus will be exposed, meaning an alloy having a higher "melting temperature" may be used).

When the perforating gun 16 is at the surface or at a reduced depth downhole, the increased shear strength of the solid eutectic alloy in annular ring 52 serves to prevent detonation of the perforating gun 16 by preventing downward movement of firing pin piston assembly 48. Annular ring 52 preferably extends about two inches along the length of piston shaft 74 when an eutectic alloy is used as the transition material. Without losing any downhole performance, annular ring 52 may be extended to whatever length is found to be necessary to prevent detonation at the surface. As perforating apparatus 10 is lowered downhole, the temperature will rise past the "melting temperature" and the eutectic alloy in annular ring 52 will change phase from a solid state to a fluid state. Thus, when perforating gun 16 is properly positioned at the predesignated depth (where they are proximate the oil or gas formation 18), the eutectic alloy is in a liquid state.

Thus, when the eutectic alloy in annular ring 52 is in a liquid state, the primary resistance to the downward movement of firing pin piston assembly 48 is provided by shear pins 54. Shear pins 54 will hold firing pin piston assembly 48 in place up to their design limits. When firing pin 44 strikes first initiator 46, it detonates first booster 47, first detonating cord 49 and second booster 51. If the eutectic alloy is in a liquid state, the pressure acting on firing pin piston assembly 48 will exceed the design limits of shear pins 54, causing shear pins 54 to shear. Firing pin piston assembly 48 moves downward until firing pin 56 contacts second initiator 60, thereby detonating third booster 58 which, in turn, detonates the upper end of second detonating cord 71.

During assembly, the eutectic alloy will be melted and poured into position in annular chamber 76 prior to placement of retention block 65. The eutectic alloy will then be allowed to harden to form annular ring 52 in chamber 76. Alternatively, the eutectic alloy may be molded as a solid, such as in "clamshell" form and placed in solid form around firing pin piston assembly 48 during assembly.

Initiators 46, 60 are of a type known to those skilled in the art. When boosters 47, 51, 58 detonate, they preferably yield between 70,000–120,000. p.s.i. Boosters 47, 51, 58 also are of a type known to those skilled in the art. Boosters which may be used include PYX, HMX and RDX standard boosters. In one preferred embodiment, boosters 47, 51, 58 are bi-directional boosters. Detonating cords 49 and 71 are likewise of a type known to those skilled in the art as "primacord." One detonating cord which may be used in available through Ensign-Bickford Company. Detonating cord 71 combusts along its length to the lower end of the detonating cord 71, where it detonates perforating gun 16 in a manner well known to the art. Perforating gun 16 then perforates the well casing 14 and formation 18.

The operation of perforating apparatus 10 is as follows. Perforating apparatus 10 is assembled on the surface as has been hereinbefore described. Perforating apparatus 10 is, therefore, at the ambient surface temperature. Thus, the eutectic alloy in annular ring 52 is in a solid state. On the surface, the increased shear strength of the solidified eutectic alloy in annular ring 52 serves to prevent the issuance of a detonation signal to the perforating gun 16 by inhibiting any downward movement of firing pin piston assembly 48. Once assembled, perforating apparatus 10 is inserted down the bore of well casing 14 until perforating gun 16 is proximate the oil or gas formation 18 desired to be perforated. As the perforating apparatus 10 is lowered downhole, the temperature of the apparatus rises and, as a result, the temperature of the eutectic alloy in annular ring 52 also rises. At a certain depth, preferably well above the depth where perforating gun 16 is proximate the oil or gas formation 18 to be perforated, the temperature of the eutectic alloy rises above the "melting temperature." The eutectic alloy then changes state from a solid to a liquid. Even though the liquified eutectic alloy in annular ring 52 does not significantly inhibit movement of firing pin piston assembly 48, firing pin piston assembly 48 continues to be held in place by shear pins 54.

When it is desired to detonate perforating gun 16, pressure will be applied to fluid in the tubing string to shear shear pins 42. The fluid pressure in tubing string 22 urges hydraulically-actuated piston 40 downward until firing pin 44 strikes first initiator 46. When firing pin 44 strikes first initiator 46, first booster 47 is detonated. First booster 47 detonates first detonating cord 49 which, in turn, detonates second booster 51, proximate firing pin piston assembly 48 in detonation interruption apparatus 50.

As has already been described, the liquified eutectic alloy has low shear strength and offers little resistance to the downward movement of firing pin piston assembly 48. The primary resistance to the downward movement of firing pin piston assembly 48 is provided by shear pins 54. Shear pins 54 will hold firing pin piston assembly 48 in place up to their design limits (preferably approximately 1700 lbs. force double shear per pin for many applications). The pressure generated by the detonation of second booster 51 exceeds the design limits of shear pins 54, causing shear pins 54 to shear. Firing pin 56 strikes second initiator 60, thereby detonating third booster 58. Third booster 58 in turn detonates the upper end of second detonating cord 71, which combusts along its length to detonate the shaped charges 69 in perforating gun 16, resulting in perforation of the well casing 14 and formation 18 in a conventional manner.

Thus, when an actuation signal is received by detonation interruption apparatus 50 at depth, apparatus 50 will pass on a detonation signal to the perforating gun or other detonating device. However, when an actuation signal is received by detonation interruption apparatus 50 when it is not downhole, apparatus 50 will not issue a detonation signal to the perforating gun or other detonating device.

The specific eutectic alloy selected to be used in a given firing head assembly 34 depends on the highest potential ambient surface temperature as well as the depth downhole at which perforating apparatus 10 is to be operated. Various eutectic alloys having "melting temperatures" ranging from about 117 degrees Fahrenheit to about 281 degrees Fahrenheit are available. The shear strengths of these eutectic alloys in a solid state range from 5,400–8,000. p.s.i.

For various reasons, it is sometimes desirable to retrieve perforating apparatus 10 from downhole even through perforating gun 16 has not yet been detonated. As perforating apparatus 10 is raised, the temperature of the eutectic alloy in annular ring 52 drops. At a certain depth, the temperature of the eutectic alloy drops below the "melting temperature." The eutectic alloy in annular ring 52 changes state from a liquid to a solid. The resolidified eutectic alloy will now again prevent movement of firing pin piston assembly 48. Thus, detonation interruption apparatus 50 renders perforating gun 16 inoperative for all intents and purposes whenever the equipment is exposed to ambient surface temperatures.

Although the detonation interruption apparatus has only been illustrated herein as being used downhole in a substantially upright and vertical orientation, it is important to note that it is not limited to such applications. As will be understood by those skilled in the art, the detonation interruption apparatus will be equally effective no matter what its orientation is when it is downhole. Thus, when a redundant, or secondary, firing system is desired, the detonation interruption apparatus will remain effective when it is used under the perforating gun, between the gun and the secondary firing head assembly, in an upside-down orientation. Similarly, the detonation interruption may be effectively used in a deviated well, even where the wellbore proximate the formation is substantially horizontal.

Figure 4A:
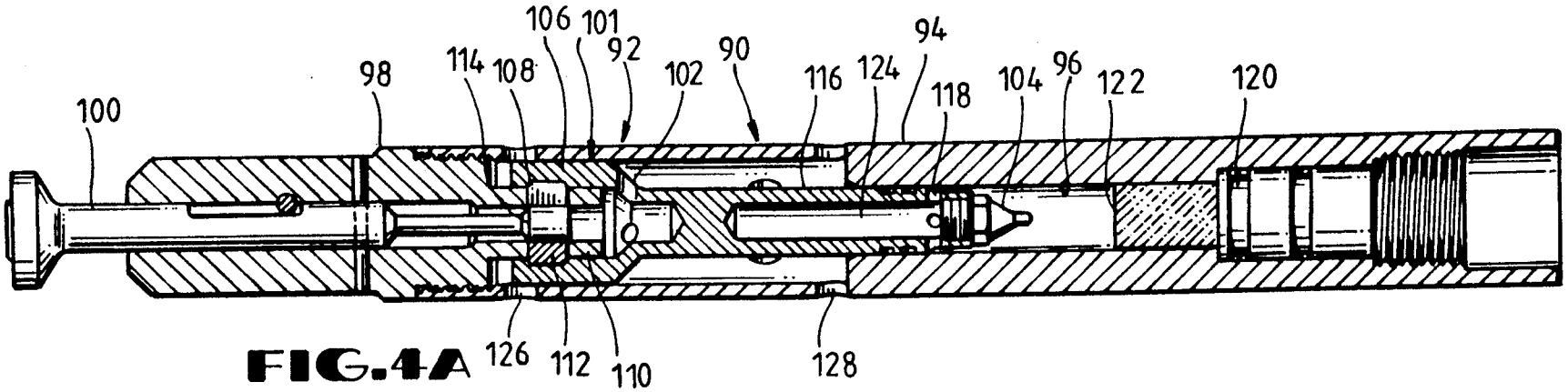
FIGS. 4*a*+*b* depict a cross-sectional side view of an alternative embodiment of a detonation interruption apparatus in accordance with the present invention.
Figure 4B:
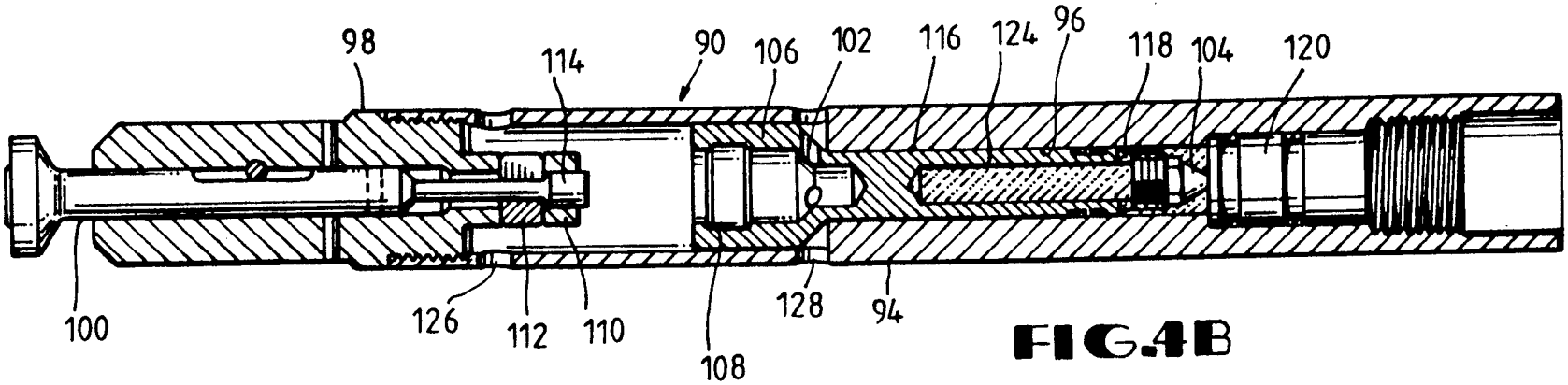

Referring to FIG. 4, an alternative embodiment of detonation interruption apparatus is shown incorporated into a firing head assembly, indicated generally at 90. Firing head assembly 90 is hybrid-type system wherein a mechanical impact is used to release an actuation piston 100, while a hydraulically-responsive piston 101 is moved downward to strike an initiator 120.

Firing head assembly 90 includes a housing assembly, indicated generally at 92. Housing assembly 92 includes a lower housing member 94, which defines a firing pin bore 96. Housing assembly 92 also includes an upper housing cap 98 which receives actuation piston 100.

Contained within housing assembly 92 is a firing pin assembly 102. Firing pin assembly 102 includes both a firing pin 104 proximate a first, lower, end; and a retention section 106 proximate a second, upper, end. Firing pin assembly 102 is retained in a first, unactuated, position relative to housing assembly 92 through the action of retention section 106. Retention section 106 forms a cup, which includes a radially inwardly facing groove 108. This cup extends around a lower extension 110 of upper housing cap 98. This extension 110 includes a plurality of radial apertures into which a plurality of latching segments 112 are inserted. These latching segments 112 are retained in a first, engaged, position, as shown in FIG. 4A, by a relatively enlarged extension 114 of actuation piston 100. When latching segments 112 are in this first position, they engage both upper housing cap 98 and retention section 106 of firing pin assembly 102 to retain the two members in a relatively fixed position.

As can be seen in FIG. 4A, lower extension 116 of firing pin assembly 102 is hollow, and is in fluid communication, through ports 118, with firing pin bore 96. Adjacent a lower end of firing pin bore 96 is a conventional initiator 120, which is designed to ignite upon impact by firing pin 104. As can be seen in FIG. 4A, a volume of a transition material 122, such as an eutectic alloy as described above herein, is placed within firing pin bore 96 between firing pin 104 (when firing pin assembly 102 is in the first, unactuated, position), and initiator 120. Thus, when transition material 122 is in a solid state, it will preclude the impact of firing pin 104 upon initiator 120. However, when transition material 122 is in a liquid state, movement of firing pin assembly 102 will be facilitated, with transition material 122 flowing around firing pin 104, through ports 118, and into hollow cavity 124 within firing pin assembly 102.

When firing head assembly 90 is to be actuated, actuation piston 100 will be moved downwardly, such as through an impact from a detonation bar, in a conventional manner. At such time, enlarged extension 114 of actuation piston 100 will be moved out of adjacent registry with latching segments 112, whereby latching segments 112 will be free to move inwardly, thereby releasing retention section 106 of firing pin assembly 102. Thereafter, fluid pressure, transmitted through ports 126 and 128 in lower housing member 94 will drive firing pin assembly 102 downwardly. Transition material 122 will then flow in the manner described above, allowing firing pin 104 to strike initiator 120. This ignition will then cause actuation of an attached perforating gun or other explosive device in a conventional manner.

In addition, although the detonation interruption apparatus has been illustrated herein as being used in conjunction with a perforating apparatus, it will be clear to one skilled in the art that it may be utilized in any application requiring a firing head or an analogous assembly. For instance, when a downhole pipe becomes lodged or stuck in a well such that it cannot be freed, a cutter is used to cut the pipe above the lodged section in order to retrieve as much of the pipe as is possible. The detonation interruption apparatus of the present invention may be used between the actuation assembly and the pipe cutter to prevent accidental detonation of the pipe cutter on the surface. Thus, the same detonation interruption apparatus can be quickly and easily screwed into a tool string adjacent a firing assembly anytime a firing assembly is required. As will be obvious to those skilled in the art, the detonation interruption apparatus can also be adapted for use with a string shot or any other ballistic devices used for oil well completion or workover. The detonation interruption apparatus as depicted in FIG. 3 is an independent unit, and can therefore be installed in conjunction with any downhole firing system. The detonation interruption apparatus may also be constructed as an integral portion of a detonation assembly.

Some of the embodiments of detonation interruption apparatus illustrated herein have been described in conjunction with a hydraulically-actuated firing head. Others have been described in conjunction with a mechanically-actuated firing head. It will be understood by those skilled in the art that each of the various embodiments may be adapted for use with any firing head, regardless of the type of actuation signal, whether mechanical, hydraulic or electrical, to which the firing head or other firing assembly is designed to be responsive.

An eutectic alloy has been used as the transition material in the present invention for illustrative purposes only. It will be obvious to one skilled in the art that other materials having the requisite properties and characteristics of a transition material may be used in lieu of the eutectic alloy disclosed herein. In addition, it has been assumed herein that the downhole temperature proximate formation 18 is well above the "melting temperature" of the transition material being used. Thus, after perforating gun 16 is positioned proximate formation 18, no period of waiting is required before perforating gun 16 may be detonated. However, if the downhole temperature proximate formation 18 is only marginally above the "melting temperature" of the transition material being used, a period of waiting of at least above 30 minutes is required before perforating gun 16 should be detonated. This waiting period will ensure that the transition material has completely changed state from a solid to a fluid.

The description of the present invention has been presented for purposes of illustration and description, but is not intended to be exhaustive or limit the invention in the precise form disclosed. For example, in the embodiment of FIG. 3, the annular ring containing the transition material could be formed around hydraulically-actuated piston 40 instead of around firing pin piston assembly 48. Many additional modifications and variations may be made to the techniques and structures described and illustrated herein.

What is claimed is:

1. An explosive system for use in a well, said system comprising:

(a) a firing head including a first combustible member, said firing head operable to receive an actuation signal and to establish a first detonation signal through use of said first combustible member when said actuation signal is received;

(b) a detonation interruption apparatus, said apparatus including an apparatus housing assembly, a moveable member, a restraining member and a second combustible member, said apparatus housing assembly operably coupled to said firing head, said moveable member contained within said apparatus housing assembly, said restraining member contained within said apparatus housing assembly, said second combustible member at least partially contained within said apparatus housing assembly, said restraining member formed of a transition material, said transition material transformable between a solid state and a fluid state as a function of temperature, said restraining member retaining said moveable member in a first, unactuated position when said restraining member is in a solid state, said apparatus operable to receive said first detonation signal, said moveable member moveable from said first, unactuated position to a second, actuated position in response to said first detonation signal when said restraining member is in a fluid state, said apparatus operable to establish a second detonation signal through use of said second combustible member when said moveable member is moved to said second, actuated position;

(c) an explosive operably coupled to said detonation interruption apparatus, said explosive operable to receive said second detonation signal and to detonate when said second detonation signal is received.

2. The explosive system of claim 1 wherein said moveable member comprises a firing piston, and wherein said apparatus housing assembly and said firing piston are cooperatively arranged to define a chamber, wherein said restraining member is housed within said chamber.

3. The explosive system of claim 2 wherein said firing piston includes along its length a first region, a second region and a third region, said first region and said third region having an increased width compared to said second region, said chamber defined at least partially between said first region and said third region.

4. The explosive system of claim 3 wherein said first region, said second region and said third region are each generally cylindrically shaped and wherein said apparatus housing assembly defines a cylindrical bore therethrough, the diameter of said first region being approximately equal to the diameter of said third region, the diameter of said first region being greater than the diameter of said second region.

5. The explosive system of claim 4 wherein said firing piston comprises a first end and a second end and wherein said first region of said firing piston is located proximate said first end and wherein said third region of said firing piston is located proximate said second end.

6. The explosive system of claim 5 wherein said firing piston further comprises a firing pin, said firing pin extending from said first end of said firing piston, said detonation interruption apparatus further comprising an initiator, said firing piston in said first, unactuated position being in spaced relation relative to said initiator, said firing piston in said second, actuated position being proximate said initiator with said firing pin contacting said initiator.

7. A perforating system for perforating a well, said system comprising:

(a) a firing head including a first combustible member, said firing head operable to receive an actuation signal and to establish a first detonation signal through use of said first combustible member when said actuation signal is received;

(b) a detonation interruption apparatus, said apparatus including an apparatus housing assembly, a moveable member, a restraining member and a second combustible member, said apparatus housing assembly operably coupled to said firing head, said moveable member contained within said apparatus housing assembly, said restraining member contained within said apparatus housing assembly, said second combustible member at least partially contained within said apparatus housing assembly, said restraining member formed of a transition material, said transition material transformable between a solid state and a fluid state as a function of temperature, said restraining member retaining said moveable member in a first, unactuated position when said restraining member is in a solid state, said apparatus operable to receive said first detonation signal, said moveable member moveable from said first, unactuated position to a second, actuated position in response to said first detonation signal when said restraining member is in a fluid state, said apparatus operable to establish a second detonation signal through use of said second combustible member when said moveable member is moved to said second, actuated position;

(c) a perforating gun operably coupled to said detonation interruption apparatus, said perforating gun operable to receive said second detonation signal and to detonate when said second detonation signal is received.

8. The perforating system of claim 7 wherein said moveable member comprises a firing piston, and wherein said apparatus housing assembly and said firing piston are cooperatively arranged to define a chamber, wherein said restraining member is housed within said chamber.

9. The perforating system of claim 8 wherein said firing piston includes along its length a first region, a second region and a third region, said first region and said third region having an increased width compared to said second region, said chamber defined at least partially between said first region and said third region.

10. The perforating system of claim 9 wherein said first region, said second region and said third region are each generally cylindrically shaped and wherein said apparatus housing assembly defines a cylindrical bore therethrough, the diameter of said first region being approximately equal to the diameter of said third region, the diameter of said first region being greater than the diameter of said second region.

11. The perforating system of claim 10 wherein said firing piston comprises a first end and a second end and wherein said first region of said firing piston is located proximate said first end and wherein said third region of said firing piston is located proximate said second end.

12. The perforating system of claim 11 wherein said firing piston further comprises a firing pin, said firing pin extending from said first end of said firing piston, said detonation interruption apparatus further comprising an initiator, said firing piston in said first, unactuated position being in spaced relation relative to said initiator, said firing piston in said second, actuated position being proximate said initiator with said firing pin contacting said initiator.

13. A detonation interruption apparatus, said apparatus comprising:

(a) an apparatus housing assembly;

(b) a moveable member contained within said apparatus housing assembly;

(c) a restraining member contained within said apparatus housing assembly, said restraining member formed of a transition material, said transition material transformable between a solid state an a fluid state as a function of temperature, said restraining member retaining said moveable member in a first, unactuated position when said restraining member is in a solid state, said apparatus operable to receive a fist detonation signal, said moveable member moveable from said first, unactuated position to a second, actuated position in response to said first detonation signal when said restraining member is in a fluid state, said apparatus operable to establish a second detonation signal through use of combustible member when said moveable member is moved to said second, actuated position.

14. The detonation interruption apparatus of claim 13 wherein said moveable member comprises a firing piston, and wherein said apparatus housing assembly and said firing piston are cooperatively arranged to define a chamber, wherein said restraining member is housed within said chamber.

15. The detonation interruption apparatus of claim 14 wherein said firing piston includes along its length a first region, a second region and a third region, said first region and said third region having an increased width compared to said second region, said chamber defined at least partially between said first region and said third region.

16. The detonation interruption apparatus of claim 15 wherein said first region, said second region and said third region are each generally cylindrically shaped and wherein said apparatus housing assembly defines a cylindrical bore therethrough, the diameter of said first region being approximately equal to the diameter of said third region, the diameter of said first region being greater than the diameter of said second region.

17. The detonation interruption apparatus of claim 16 wherein said firing piston comprises a first end and a second end and wherein said first region of said firing piston is located proximate said first end and wherein said third region of said firing piston is located proximate said second end.

18. The detonation interruption apparatus of claim 17 wherein said firing piston further comprises a firing pin, said firing pin extending from said first end of said firing piston, said detonation interruption apparatus further comprising an initiator, said firing piston in said first, unactuated position being in spaced relation relative to said initiator, said firing piston in said second, actuated position being proximate said initiator with said firing pin contacting said initiator.

19. A detonation interruption apparatus, said apparatus comprising:

(a) an apparatus housing assembly defining a cylindrical bore therethrough;

(b) a combustible member at least partially contained within said apparatus housing assembly;

(b) a first booster contained within said apparatus housing assembly, said first booster operably coupled to receive a detonation signal from said combustible member, said first booster generating a pressure upon detonation;

(c) an initiator contained within said apparatus housing assembly;

(d) a second booster contained within said apparatus housing assembly, said initiator operably coupled to detonate said second booster;

(e) a detonating cord at least partially contained within said apparatus housing assembly, said second booster operably coupled to detonate said detonating cord;

(f) a firing piston within said cylindrical bore, said firing piston having a first end and a second end, said first end having a cylindrical shape, said second end having a cylindrical shape, said firing piston including a recessed central region between said ends, said recessed central region having a cylindrical shape, the diameter of said first end being approximately equal to the diameter of said second end, the diameter of said first end being longer than the diameter of said recessed central region, said firing piston including a firing pin extending from said first end, said central region cooperatively arranged with said ends and said cylindrical bore to define an annular chamber, said annular chamber including a volume of an eutectic alloy, said eutectic alloy transformable between a solid state and a liquid state as a function of temperature, said eutectic alloy retaining said firing piston in a first, unactuated position in which said firing pin is in spaced relation relative to said initiator when said eutectic alloy is in a solid state, said firing piston moveable from said first, unactuated position to a second, actuated position in which said firing pin contacts said initiator in response to said pressure generated by said first booster when said eutectic alloy is in a liquid state, said initiator detonating said second booster when said firing piston is moved to said second, actuated position, said second booster detonating said detonating cord when said second booster is detonated.

20. An explosive system for use in a well, said system comprising:

(a) a firing head apparatus including an apparatus housing assembly, a moveable member contained within said apparatus housing assembly, a restraining member contained within said apparatus housing assembly, and a combustible member at least partially contained within said apparatus housing assembly, said restraining member formed of a transition material, said transition material transformable between a solid state and a fluid state as a function of temperature, said restraining member retaining said moveable member in a first, unactuated position when said retraining member is in a solid state, said apparatus operable to receive an actuation signal, said moveable member moveable from said first, unactuated position to a second, actuated position in response to said actuation signal when said restraining member is in a fluid state, wherein said moveable member includes a firing piston providing a firing pin extending therefrom, said apparatus housing assembly having a cylindrical bore therethrough, said firing piston having a cylindrically shaped exterior surface, said firing piston providing a cavity therein, said firing piston providing a passageway proximate said firing pin for fluid communication between said bore and said cavity, said firing piston in said first, unactuated position being in spaced relation relative to said initiator, said firing piston in said second, actuated position being proximate said initiator with said firing pin contacting said initiator, at least a portion of said transition material flowing into said cavity through said ports as said moveable member moves from said first, unactuated position to said second, actuated position, said apparatus operable to establish a detonation signal through use of said combustible member when said moveable member is moved to said second, actuated position;

(b) an explosive operably coupled to said apparatus housing assembly, said explosive operable to receive said detonation signal and to detonate when said detonation signal is received.

21. The explosive system of claim 20 wherein said transition material is an eutectic alloy.

22. The explosive system of claim 21 wherein said combustible member includes an initiator, a booster and a detonating cord, said initiator contained within said apparatus housing assembly, said booster contained within said apparatus housing assembly, said detonating cord at least partially contained within said apparatus housing assembly, said initiator operably coupled to said booster, said booster operably coupled to said detonating cord, said detonating cord operably coupled to said explosive, said moveable member being in spaced relation relative to said initiator when moveable member is in said first, unactuated position, said moveable member being in contact with said initiator when said moveable member is in said second, actuated position, said initiator detonating said booster when said moveable member is moved to said second, actuated position, said detonating cord detonating when said booster is detonated, said explosive detonating when said detonating cord is detonated.

23. The explosive system of claim 22 wherein said restraining member is located intermediate said moveable member and said initiator when said moveable member is in said first, unactuated position.

24. The explosive system of claim 23 wherein said moveable member includes a firing piston providing a firing pin extending therefrom, said apparatus housing assembly having a cylindrical bore therethrough, said firing piston having a cylindrically shaped exterior surface, said firing piston providing a cavity therein, said firing piston providing a passageway proximate said firing pin for fluid communication between said bore and said cavity, said firing piston in said first, unactuated position being in spaced relation relative to said initiator, said firing piston in said second, actuated position being proximate said initiator with said firing pin contacting said initiator, at least a portion of said transition material flowing into said cavity through said ports as said movable member moves from said first, unactuated position to said second, actuated position.

25. A perforating system for perforating a well, said system comprising:

(a) a firing head apparatus including an apparatus housing assembly, a moveable member contained within said apparatus housing assembly, a restraining member contained within said apparatus housing assembly, and a combustible member at least partially contained within said apparatus housing assembly, said restraining member formed of a transition material, said transition material transformable between a solid state and a fluid state as a function of temperature, said restraining member retaining said moveable member in a first, unactuated position when said restraining member is in a solid state, said apparatus operable to receive an actuation signal, said moveable member moveable from said first, unactuated position to a second, actuated position in response to said actuation signal when said restraining member is in a fluid state, wherein said moveable member includes a firing piston providing a firing pin extending therefrom, said apparatus housing assembly having a cylindrical bore therethrough, said firing piston having a cylindrically shaped exterior surface, said firing piston providing a cavity therein, said firing piston providing a passageway proximate said firing pin for fluid communication between said bore and said cavity, said firing piston in said first, unactuated position being in spaced relation relative to said initiator, said firing piston in said second, actuated position being proximate said initiator with said firing pin contacting said initiator, at least a portion of said transition material flowing into said cavity through said ports as said moveable member moves from said first, unactuated position to said second, actuated position, said apparatus operable to establish a detonation signal through use of said combustible member when said moveable member is moved to said second, actuated position;

(b) a perforating gun operably coupled to said apparatus housing assembly, said perforating gun operable to receive said detonation signal and to detonate when said detonation signal is received.

26. The perforating system of claim 25 wherein said transition material is an eutectic alloy.

27. The perforating system of claim 26 wherein said combustible member includes an initiator, a booster and a detonating cord, said initiator contained within said apparatus housing assembly, said booster contained within said apparatus housing assembly, said detonating cord at least partially contained within said apparatus housing assembly, said initiator operably coupled to said booster, said booster operably coupled to said detonating cord, said detonating cord operably coupled to said explosive, said moveable member being in spaced relation relative to said initiator when moveable member is in said first, unactuated position, said moveable member being in contact with said initiator when said moveable member is in said second, actuated position, said initiator detonating said booster when said moveable member is moved to said second, actuated position, said detonating cord detonating when said booster is detonated, said explosive detonating when said detonating cord is detonated.

28. The perforating system of claim 27 wherein said restraining member is located intermediate said moveable member and said initiator when said moveable member is in said first, unactuated position.

29. The perforating system of claim 28 wherein said moveable member includes a firing piston providing a firing pin extending therefrom, said apparatus housing assembly having a cylindrical bore therethrough, said firing piston having a cylindrically shaped exterior surface, said firing piston providing a cavity therein, said firing piston providing a passageway proximate said firing pin for fluid communication between said bore and said cavity, said firing piston in said first, unactuated position being in spaced relation relative to said initiator, said firing piston in said second, actuated position being proximate said initiator with said firing pin contacting said initiator, at least a portion of said transition material flowing into said cavity through said ports as said moveable member moves from said first, unactuated position to said second, actuated position.

30. An explosive system for use in a well, said system comprising:

(a) a firing head apparatus including an apparatus housing assembly, a moveable member contained within said apparatus housing assembly, an attachment member at least partially contained within said apparatus housing assembly, a restraining member contained within said apparatus housing assembly, and a combustible member at least partially contained within said apparatus housing assembly, said restraining member formed of a transition material, said transition material transformable between a solid state and a fluid state as a function of temperature, said attachment member moveable from a first, fastening position in which said attachment member secures said moveable member in a first, unactuated position to a second, releasing position in which said attachment member does not secure said moveable member in said first, unactuated position, said restraining member retaining said moveable member in said first, unactuated position when said restraining member is in a solid state, said attachment member operable to receive a mechanical actuation signal, said attachment member moving from said first, fastening position to said second, releasing position in response to said mechanical actuation signal, said moveable member operable to receive a hydraulic actuation signal, said moveable member moveable from said first, unactuated position to a second, actuated position in response to said hydraulic actuation signal when said attachment member is in said second, releasing position and said restraining member is in a fluid state, wherein said moveable member includes a firing piston providing a firing pin extending therefrom, said apparatus housing assembly having a cylindrical bore therethrough, said firing piston having a cylindrically shaped exterior surface, said firing piston providing a cavity therein, said firing piston providing a passageway proximate said firing pin for fluid communication between said bore and said cavity, said firing piston in said first, unactuated position being in spaced relation relative to said initiator, said firing piston in said second, actuated position being proximate said initiator with said firing pin contacting said initiator, at least a portion of said transition material flowing into said cavity through said ports as said moveable member moves from said first, unactuated position to said second, actuated position, said apparatus operable to establish a detonation signal through use of said combustible member when said moveable member is moved to said second, actuated position;

(b) an explosive operably coupled to said apparatus housing assembly, said explosive operable to receive said detonation signal and to detonate when said detonation signal is received.

31. The explosive system of claim 30 wherein said transition material is an eutectic alloy.

32. The explosive system of claim 31 wherein said combustible member includes an initiator, a booster and a detonating cord, said initiator contained within said apparatus housing assembly, said booster contained within said apparatus housing assembly, said detonating cord at least partially contained within said apparatus housing assembly, said initiator operably coupled to said booster, said booster operably coupled to said detonating cord, said detonating cord operably coupled to said explosive, said moveable member being in spaced relation relative to said initiator when moveable member is in said first, unactuated position, said moveable member being in contact with said initiator when said moveable member is in said second, actuated position, said initiator detonating said booster when said moveable member is moved to said second, actuated position, said detonating cord detonating when said booster is detonated, said explosive detonating when said detonating cord is detonated.

33. The explosive system of claim 32 wherein said restraining member is located intermediate said moveable member and said initiator when said moveable member is in said first, unactuated position.

34. A firing head apparatus for use in a well, said apparatus comprising:

(a) an apparatus housing assembly;

(b) a moveable member contained within said apparatus housing assembly;

(c) an attachment member at least partially contained within said apparatus housing assembly;

(d) a restraining member contained within said apparatus housing assembly;

(e) a combustible member at least partially contained within said apparatus housing assembly;

(f) said restraining member formed of a transition material, said transition material transformable between a solid state and a fluid state as a function of temperature, said attachment member moveable from a first, fastening position in which said attachment member secures said moveable member in a first, unactuated position to a second, releasing position in which said attachment member does not secure said moveable member in said first, unactuated position, said restraining member retaining said moveable member in said first, unactuated position when said retraining member is in a solid state, said attachment member operable to receive a mechanical actuation signal, said attachment member moving from said first, fastening position to said second, releasing position in response to said mechanical actuation signal, said moveable member operable to receive a hydraulic actuation signal, said moveable member moveable from said first, unactuated position to a second, actuated position in response to said hydraulic actuation signal when said attachment member is in said second, releasing position and said restraining member is in a fluid state wherein said moveable member includes a firing piston providing a firing pin extending therefrom, said apparatus housing assembly having a cylindrical bore therethrough, said firing piston having a cylindrically shaped exterior surface, said firing piston providing a cavity therein, said firing piston providing a passageway proximate said firing pin for fluid communication between said bore and said cavity, said firing piston in said first, unactuated position being in spaced relation relative to said initiator, said firing piston in said second, actuated position being proximate said initiator with said firing pin contacting said initiator, at least a portion of said transition material flowing into said cavity through said ports as said moveable member moves from said first, unactuated position to said second, actuated position, said apparatus operable to establish a detonation signal through use of said combustible member when said moveable member is moved to said second, actuated position.

35. The firing head apparatus of claim 34 wherein said transition material is an eutectic alloy.

36. The firing head apparatus of claim 35 wherein said combustible member includes an initiator, a booster and a detonating cord, said initiator contained within said apparatus housing assembly, said booster contained within said apparatus housing assembly, said detonating cord at least partially contained within said apparatus housing assembly, said initiator operably coupled to said booster, said booster operably coupled to said detonating cord, said detonating cord operably coupled to said explosive, said moveable member being in spaced relation relative to said initiator when moveable member is in said first, unactuated position, said moveable member being in contact with said initiator when said moveable member is in said second, actuated position, said initiator detonating said booster when said moveable member is moved to said second, actuated position, said detonating cord detonating when said booster is detonated, said explosive detonating when said detonating cord is detonated.

37. The firing head apparatus of claim 36 wherein said restraining member is located intermediate said moveable member and said initiator when said moveable member is in said first, unactuated position.

* * * * *

UNITED STATES PATENT AND TRADEMARK OFFICE

CERTIFICATE OF CORRECTION

PATENT NO. : 5,223,665

DATED : JUNE 29, 1993

INVENTOR(S) : JOHN D. BURLESON AND DIETER KLEIN

It is certified that error appears in the above-indentified patent and that said Letters Patent is hereby corrected as shown below:

In column 10, line 33 "above" should read "about".

Signed and Sealed this

Twenty-ninth Day of March, 1994

Bruce Lehman

*Attest:*

BRUCE LEHMAN

*Attesting Officer*

*Commissioner of Patents and Trademarks*